US005669831A

United States Patent [19]

Lutz

[11] Patent Number: 5,669,831

[45] Date of Patent: Sep. 23, 1997

[54] POLYORGANO-SILOXANE CLEAR COATS FOR GOLF BALLS

[75] Inventor: Mitchell E. Lutz, Fairhaven, Mass.

[73] Assignee: Acushnet Company, Fairhaven, Mass.

[21] Appl. No.: 484,242

[22] Filed: Jun. 7, 1995

[51] Int. Cl.[6] ..... A63B 37/12

[52] U.S. Cl. ..... 473/377; 473/378; 524/908

[58] Field of Search ..... 473/378, 377

[56] References Cited

U.S. PATENT DOCUMENTS 5,409,233 4/1995 Kennedy ..... 273/235 A 5,461,109 10/1995 Blair et al. ..... 524/839

*Primary Examiner*—Ralph H. Dean

*Attorney, Agent, or Firm*—Pennie & Edmonds

[57] ABSTRACT

The present invention is directed towards a golf ball comprising a core, a cover and a protective clear coat layer, wherein the clear coat layer comprises a polyorgano-siloxane polymer. The novel clear coat compositions of the present invention are believed to provide enhanced abrasion resistance, impact resistance, and chemical resistance as well as diminished photodecomposition and increased adhesion. Optionally, the golf balls of the present invention may also employ at least one primer layer disposed between the cover and clear coat layer to improve the adhesion and physical properties of the polyorgano-siloxane clear coat compositions. Likewise, the present invention provides a method for producing the clear coat compositions of the present invention.

18 Claims, No Drawings

POLYORGANO-SILOXANE CLEAR COATS FOR GOLF BALLS

FIELD OF INVENTION

This invention relates generally to coatings, more particularly to coatings for golf balls, and still more particularly to a coating for a golf ball comprising a polyorgano-siloxane polymer clear coat composition. The presently claimed coatings comprising polyorgano-siloxane polymers are believed to provide a variety of characteristics such as enhanced abrasion, impact and weathering resistance, as well as increased adhesion to various substrates, all of which extend the service life of the golf ball.

BACKGROUND OF THE INVENTION

Conventional golf balls can be classified as one-piece, two-piece, and three-piece (also known as "wound"). One-piece balls are molded from a homogeneous mass of material with a dimple pattern molded therein. Two-piece balls are made by molding a cover about a solid core. Three-piece or wound balls are made by molding a cover about a wound core. The core is typically made of rubber and can be solid, semi-solid or have a liquid center. A wound core is prepared by winding a lengthy thread of elastic material about the center core. The wound core is then covered with a cover material. Additionally, the recent trend in the golf ball art is towards the development of multi-component golf balls such as balls with two or more cover layers, two or more core layers or both multiple core and multiple cover layers.

The covers of today's golf balls are made from any number of materials such as Balata, SURLYN, IOTEK and polyurethane, depending upon the desired performance characteristics of the golf ball. One of the softest materials conventionally used as golf ball covers is Balata, which is the trans form of the 1,4-chain polymer of isoprene. For many years, balata was the standard cover stock material for most golf balls. Balata covered balls are favored among professionals and more advanced amateur players because the softness of the cover allows the player to achieve spin rates sufficient to more precisely control ball direction and distance, particularly on shorter approach shots. However, because of its softness, balata is susceptible to cuts or other damage to the cover resulting from a "mis-hit" shot. Accordingly, harder, more durable cover materials such as ionomer resins such as SURLYN have been developed which provide a higher durability, but less spin and feel than the balata balls. Ionomeric resins such as SURLYN are generally ionic copolymers of an olefin such as ethylene and a metal salt of an unsaturated carboxylic acid such as acrylic acid, methacrylic acid or maleic acid. Metal ions, such as lithium, zinc or sodium are used to neutralize some portion of the acidic groups in the copolymer resulting in a thermoplastic elastomer for use as a golf ball cover. Additionally, various softening comonomers such as n-butyl acrylate may be added during the ionomer manufacturing process to improve golf ball performance characteristics such as spin and feel. Further, in the early 1980s, low modulus SURLYN ionomers were introduced and subsequently utilized to impart more spin and improved, balata-like feel to golf balls.

All golf balls, regardless of type have an outer surface which contains a dimple pattern. Dimples are depressions or indentations formed into the outer surface of the ball to provide desired aerodynamic effects.

Golf balls are provided in a variety of colors. Conventionally they are white, but may be manufactured with essentially any color desired, including yellow, orange and pink. The color is imparted to the ball by either layers of paint applied to the outer surface of the ball or by incorporating a pigment directly into the cover composition. Typically, in a painted ball, a first primer layer is applied and then a second finishing coat layer is applied. After a ball has been provided with a color, identifying indicia such as a trademark, logo, identification number, model name or number and the like are stamped onto the ball. When the pigment is incorporated directly into the cover layer, a prime coat and a top coat layer are usually applied to provide a high gloss and an overall enhanced appearance to the ball. In these golf balls, the various identifying indicia may be applied to either the cover, the prime coat or the topcoat.

It is important that golf balls be capable of withstanding a variety of weather conditions such as sunlight, extreme temperature ranges, and immersion in water, preferably for an extended period. Further, the surface of golf balls are flexed and impacted every time they are struck with a club and consequently must be able to withstand such repeated stresses. Moreover, especially with the recreational player, golf balls are susceptible of striking any of a number of hard, abrasive surfaces such as concrete, asphalt, brick, stone, etc. as a result of errant shots.

Naturally, it is desirable for golf ball manufacturers that their golf balls be resistant to delamination or chipping of the paint layers, as such defects impacts negatively upon the public perception of the quality of the golf ball. Likewise, golf ball manufacturers would like to prevent obliteration of all or part of their trademarks, logos or other identifying indicia which identifies the brand of the ball to the playing public.

Clear coats are applied to protect the ball, the identifying indicia, any clear or colored paint layers, and to add a pleasing appearance to the ball due to their high gloss and the mirror-like surface they produce. The term clear coat means a coating applied to the outer surface of the golf ball which is transparent and imparts glossy or shiny appearance to the ball as well as providing a measure of protection and durability to the cover of the ball. Clear coats are generally free of pigmentation and are water white. However, they may contain small amounts of dye, pigment, and optical brighteners so long as they are still transparent.

Protective clear coat materials are well known in the golf ball art. Generally, they consist of urethanes, urethane hybrids, polyesters and acrylics. Further, more than one clear coat can be used. Typical two pack polyurethane coatings consist of separate packages of polyol and diisocyanate. Conventionally, a primer layer such as a solvent-based or a water-based polymer may be applied to promote adhesion or smooth surface roughness before the finish coat or coats are deposited on the golf ball. In general, a cured polyurethane top coat is most widely used as a protective coating material.

Although conventional clear coats such as polyurethane provide a shiny appearance and a measure of protection against weathering and abrasion, a need exists for an improved protective clear coat composition for golf balls which provides a higher durability than the coating compositions of the prior art.

OBJECT OF THE INVENTION

An object of the present invention is an improved protective coating for golf balls which provides enhanced abrasion and impact resistance, enhanced weathering properties and enhanced adhesion to various substrates.

A further object of the present invention is the novel use of polyorgano-siloxane polymers as a protective clear coat layer for golf balls.

A still further object of the present invention is to provide a method for applying a clear coat layer of an polyorgano-siloxane polymer to a golf ball.

SUMMARY OF THE INVENTION

The present invention is directed towards an improved protective clear coat layer for golf balls which imparts a higher durability than the clear coatings of the prior art.

The present invention is further directed towards the novel use of polyorgano-siloxane polymers in golf ball clear coat layer compositions.

The present invention is still further directed towards a golf ball which comprises a core, a cover and a clear coat layer, wherein the clear coat layer is the outermost layer and comprises a polyorgano-siloxane polymer.

The present invention is also directed towards a golf ball which comprises a core, a cover, at least one primer layer and a clear coat layer, wherein the primer layer is disposed between the clear coat layer and the cover, the clear coat layer being the outermost layer and comprising an polyorgano-siloxane polymer.

The present invention is also directed towards a method of producing a clear coat layer of a polyorgano-silicone polymer by depositing a silane prepolymer composition on the outer surface of a golf ball and curing such prepolymer by exposure to heat or radiation to sufficiently crosslink and increase the molecular weight of the composition so as to form a polymer. Optionally, such method may also include the deposition of a primer layer on the surface of the cover prior to the deposition of the silane prepolymer composition.

DETAILED DESCRIPTION OF THE INVENTION

As used herein, the term "polyorgano-siloxane polymer" or silicone means a polymer based on a structure consisting of alternate silicon and oxygen atoms with various organic functional groups attached to the silicon backbone and consisting of various combinations of functionality known in the art. Generic examples appear below and the invention should not be limited to the linear examples shown. Some specific examples of the structure of polyorgano-siloxane polymers of the present invention are shown in Formula I and Formula II

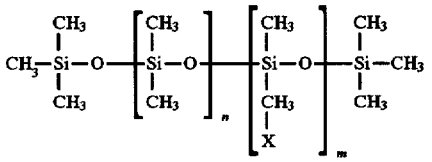

Formula I

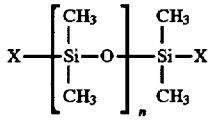

Formula II

Wherein X is a functional group and n and m are integers.

As used herein, the term "monomer" means any species which consist of one, or at most a few, repeat units, which upon exposure to a source of energy such as radiation, can be combined to give a higher molecular weight structure which is usually crosslinked. Radiation curable oligomers or prepolymers are generally much lower in molecular weight than resins. The terms "oligomer" and "prepolymer" are generally used interchangeably in the coatings art and are understood to be distinct from the term "monomers".

While a monomer is a species that can be polymerised as discussed above, the coatings art refers to monomers as single units which are polymerisable through the effects of chemical reaction and which are generally of lower molecular weight than oligomers and prepolymers. Monomers are almost always lower in viscosity than oligomers and as such are used as reactive diluents to decrease the viscosity of certain curable formulations, improve the cure speed, and increase the crosslink density.

As used herein, the term polymer means any type of polymer including random polymers, graft polymers, block polymers, etc.

This invention is particularly directed towards a golf ball which comprises a core, a cover and a clear coat layer, wherein the clear coat layer comprises a polyorgano-siloxane polymer. Any number of polyorgano-siloxane polymers are contemplated as being useful in the present invention.

The desirable properties of polyorgano-siloxane polymers which make them useful in clear coat layers for a golf ball are a result of their unique chemical structure. Typically, golf balls are coated with a polyurethane, which has a carbon-carbon molecular backbone. However, polyorgano-siloxane polymers are characterized instead by a molecular backbone of alternating silicon and oxygen atoms. This silicon-oxygen linkage system resembles the bonds found in other heat resistant,chemically inert, physically stable, abrasion resistant materials such as ceramic, glass and quartz. In contrast, organic compounds with a carbon-carbon backbone are much more likely to oxidize and break down when exposed to UV radiation, ozone, chemicals and weathering. It is well known that it takes less energy (about 144 kcal/mole) to break a C—C bond, than that required to break a Si—O bond (about 188 kcal/mole)(see The Chemical Rubber Company, *Handbook of Chemistry and Physics*, p. F177, 52nd edition, (1971)).

Further, due to their inherent oxidative stability, polyorgano-siloxane polymers provide excellent resistance to degradation by ultraviolet (UV) light. Likewise, the general inertness of the silicone molecule provides a high level of chemical resistance. Additionally, the crosslinked structure, physical chemistry and strong adhesion of polyorgano-siloxane polymers enable these materials to provide long term abrasion resistance. Polyorgano-siloxane polymers also provide thermal stability which enables them to maintain their mechanical, chemical and physical properties over broad temperature ranges. Accordingly, as a result of their chemical structure, the polyorgano-siloxane polymer clear coat layers of the present invention are believed to have improved resistance to photodegredation, ozone, weathering, chemical attack and abrasion as compared to the conventional clear coat compositions such as polyurethane disclosed by the prior art.

The clear coats of the present invention can be applied to any of the cover compositions employed in the golf ball art. Examples of such conventional coating compositions include balata, ionomer resins such as SURLYN and IOTEK, and polyurethane.

In one embodiment, the present invention provides a golf ball comprising a core, a cover and a clear coat layer, wherein the clear coat layer comprises a polyorgano-siloxane polymer. The present invention contemplates the use of any number of polyorgano-siloxane polymers known in the art as well as blends thereof. Preferably, the clear coat layers of the present invention comprise a polyorgano-siloxane polymer that prior to curing contains reactive unsaturated functional pendent groups such as but not limited to epoxy, polyester, acrylate, methacrylate, allyl vinyl, and thiol/ene built into the prepolymer composition.

The clear coat layer of the present invention may further comprise a blend or mix of additional component such as monomers, oligomers, or reactive diluents of various functionality that can be used to modify properties such as hardness, crosslinking and flexibility of the final polyorgano-siloxane polymer. Likewise, the additional reactive moieties, if utilized, can be used to reduce the total cost of the coating. In one particular embodiment of the present invention, the clear coat layer comprises a hybrid blend of a polyorgano-siloxane polymer and an acrylate functional component.

When employing a blend of a polyorgano-siloxane polymer and an additional component, the clear coat layer should comprise a minimum of 10% polyorgano-siloxane polymer. Unless otherwise stated, all percentages (%) are given in weight percent.

The polyorgano-siloxane polymer resins of the present invention are provided by the deposition of a liquid silane prepolymer to the surface of the golf ball. As noted above, the silane prepolymer contains an organic unsaturated pendent group therein, such as acrylate,, epoxy, methacrylate, allyl vinyl, thiol/ene or polyester. These organic unsaturated pendent groups enable the prepolymer to react thermally or under radiation provided by sources such as ultraviolet (UV) light or electron beam accelerators in order to provide crosslinking and chain extension to create the polyorgano-siloxane polymer.

A number of preferred heat curable or UV curable silane prepolymer compositions are commercially available from Wacker Silicones Corporation of Adrian, Mich.; Tego Chemie Service USA of Hopewell, Va.; and GE Silicones of Waterford N.Y. For example, preferred heat curable silane prepolymer compositions are available from GE Silicones under the trade names SCH 1200, AS 4000, LHC 100 and SHC 1010. Typically, these silane prepolymers are applied by dip, flow, spray, electrostatic or spin coating. Substrates treated with these silane prepolymers should be allowed to dry at room temperature until tack free (15 to 20 minutes). Depending upon the specific silane prepolymer employed, the coated substrates are then heated to a temperature greater than about 30° C. in order to cure the prepolymer and form the polyorgano-siloxane clear coat layer.

Preferable UV curable silane prepolymer compositions are available from GE Silicones under the trade names UVHC8552, UVHC8553, UVHC8556, UVCH8559, UVHC8563; from Wacker Silicones under the trade name Wacker F-737; and from Tego Chemie Service under the trade names Tego Silicone Acrylate 704, Tego Silicone Acrylate 705, Tego Silicone Acrylate 706, Tego Silicone Acrylate 707, Tego Silicone Acrylate 725, Tego Silicone Acrylate 726. These silane prepolymers typically do not require the use of a primer layer. The amount of UV radiation required to cure the polyorgano-siloxanes will vary depending upon the prepolymer employed, the light configurations, the photoinitiator employed and spectral output. For example, the UVHC8552, UVHC8553 and UVHC8556 compositions require UV light of 250 to 300 nm with 150 mj/cm$^2$ of minimum energy. The UVHC8559 composition requires UV light of 200 to 385 nm with 75 mj/cm$^2$ of minimum energy. The UVC8563 compositions require UV light of about 200 to 385 nm with 30 mj/cm$^2$ of minimum energy. Typically, the wavelengths used for the initiation range from about 254 nm to about 400 nm.

Additionally, any of the additives conventionally employed in the coatings art may also be employed in golf balls having the clear coat compositions of the present invention. For example, UV stabilizers, optical brighteners, wetting agents, flow aids, catalysts, amine acrylate synergists or co-initiators to accelerate cure speed may all be employed in golf balls having the polyorgano-siloxane polymer clear coats of the present invention. Additives such as these need no be contained in the top coat, but can be contained in the cover or the primer layer.

The polyorgano-siloxane polymer clear coat layer of the present invention is formed on the golf ball cover by applying the silane prepolymer to the golf ball surface by means of any conventional application method such as dipping, spraying, electrostatic or flow coating methods. The silane prepolymer is applied so as to result in a prepolymer layer of uniform thickness around the entire outer surface of the cover. The silane prepolymer is typically applied neat and not in a carrier. However, if desired, solvents such as MAK, MIBK, xylene, glycol ethers, glycol acetates, methanol, n-butanol, isopropanol and other solvents known in the paint industry can be employed for viscosity reduction, controlling film thickness, improving wetting, rheology modification and improved application properties can be used in the viscosity and solids content of the silane prepolymer in order to facilitate the application thereof. If such solvents are employed, they amount to less than 90% by weight of the prepolymer composition. The percentage of solids content will depend on the method of application of the prepolymer and can be determined through routine experimentation.

After deposition of the silane prepolymer on the cover, the solvents, if incorporated, are flashed off. The golf ball is then subjected to radiation curing or thermal curing in order to crosslink the silane prepolymer composition and form the polyorgano-siloxane clear coat layer of the present invention. The radiation curing can be performed by exposing the coated ball to radiation sources such as ultraviolet light or an electron beam accelerator.

In a particular embodiment of the invention, the silane prepolymer material is injected directly into a mold during the thermoforming operation of the golf ball core and cover, and subsequently cured in the thermoforming mold to form the clear coat. In this embodiment of the invention, the ball is compression molded in a conventional fashion, the prepolymer can be injected directly into the mold and thermally cured to yield a finished ball with exception to the artwork or the ball can be blasted, decorated, primed and returned to the mold cavity and the liquid prepolymer is injected into the cavity and then thermoformed.

In another embodiment, the present invention provides a golf ball comprising a core, a cover, a clear coat layer and at least one primer layer, wherein the primer layer is disposed between the cover and clear coat layer and the clear coat layer is the outermost layer and comprises of an polyorgano-siloxane polymer. The primer layer promotes the adhesion to the substrate of the hardcoat layer and smoothes surface roughness thereby enhancing the appearance and general durability of the golf ball. Both the primer layer and clear coat layer should be applied in a uniform thickness. Any of a number of primer compositions conventionally used with clear coatings for golf balls are contemplated as being useful in the present invention. Preferably, the primer layers of the present invention are water-based, such as a waterborne epoxy/acrylic/urethane resin system. However, solvent-based primer systems are also contemplated as being useful in the present invention. Preferred primer layer compositions are available from GE Silicones under the trade names SHP401, LHP 100 and HHP 100.

When a primer layer is employed in the present invention, it is preferable that this layer be deposited on the golf ball cover prior to the application of the silane prepolymer composition. The primer layer is applied in such a manner as to result in a layer of uniform thickness around the entire outer surface of the cover. The viscosity and solids content of the primer layer can be adjusted by the addition of a suitable solvent such as water or butyl cellosolve in order to facilitate the application method. The primer layer can be deposited on the cover through any conventional application methods such as spray, dip, spin, electrostatic or flow coating methods. The primer layer should be allowed to air dry until tack-free before depositing the silane prepolymer thereon unless a wet on wet system is used. Depending upon the material employed in the cover, more than one primer layer may be required. For example, golf balls having a urethane or a balata cover may require two layers of primer.

The preferred thicknesses of the clear coat layer and optional primer coat layer(s) will vary depending upon the type of cover material employed. Nonetheless, the clear coat layer of the present invention should have a cured thickness of about 0.01 mils to about 3.0 mils. Preferably, the clear coat layer of the present invention has a cured thickness of less than about 2.0 mils.

When a primer layer is employed in the present invention, it should have a thickness of about 0.01 mils to about 1 mils. All thicknesses disclosed refer to the dry film thickness of each layer. Preferably, the primer layer is less than about 1.0 mils thick and the clear coat layer is less than about 2.0 mils thick.

The polyorgano-siloxane polymers of the present invention can be synthesized by a variety of routes known in the art. It is well known in the art of organic synthesis that many different synthetic protocols can be used to prepare a given compound. Different routes can involve more or less expensive reagents, easier or more difficult separation or purification procedures, straight-forward or cumbersome scale-up and higher or lower yield. The skilled chemist knows well how to balance the competing characteristics of synthetic strategies. Thus, the compounds of the present invention are not limited by choice of synthetic strategy, and any synthetic strategy that yields the compounds described above can be used.

I claim:

1. A golf ball comprising a core, a cover and a clear coat layer, wherein said clear coat layer is the outermost layer and comprises at least about 10 percent by weight of a polyorgano-siloxane polymer.

2. The golf ball of claim 1, wherein the clear coat layer is less than about 3.0 mils in thickness.

3. The golf ball of claim 1, wherein the clear coat layer comprises a blend of a polyorgano-siloxane polymer and a second component.

4. The golf ball of claim 3, wherein the second component comprises a monomer, polymer, oligomer, reactive diluent or mixtures thereof.

5. The golf ball of claim 4, wherein the second component comprises an acrylate functional component.

6. A golf ball comprising a core, a cover, at least one primer layer and a clear coat layer, wherein said primer layer is disposed between the clear coat layer and the cover, and wherein said clear coat layer is the outermost layer and comprises at least about 10 percent by weight of a polyorgano-siloxane polymer.

7. The golf ball of claim 6, wherein the primer layer is less than about 1.0 mils thick and the clear coat layer is less than about 2.0 mils thick.

8. The golf ball of claim 6, wherein the clear coat layer comprises a blend of a polyorgano-siloxane polymer and a second component.

9. The golf ball of claim 8, wherein the second component comprises a monomer, polymer, oligomer, reactive diluent or mixtures thereof.

10. The golf ball of claim 9, wherein the second component comprises an acrylate functional component.

11. The golf ball of claim 6, wherein the primer layer is a water-based or a solvent-based resin.

12. A method for making a golf ball comprising a core, a cover and a clear coat layer wherein the clear coat layer is the outermost layer and comprises at least about 10 percent by weight of a polyorgano-siloxane polymer, wherein the polyorgano-siloxane polymer is formed by:

(a) depositing a layer of a silane prepolymer on the outer surface of the golf ball; and (b) curing the silane propolymer to provide a higher molecular weight polyorgano-siloxane polymer.

13. The method of claim 12, wherein the siloxane prepolymer is cured by exposing the prepolymer to heat or radiation.

14. The method of claim 13, wherein the radiation is provided by ultraviolet light or an electron beam accelerator.

15. The method of claim 12, wherein the siloxane prepolymer is deposited by dipping, spraying, spin, electrostatic or flow coating.

16. The method of claim 12, wherein the golf ball further comprises at least one primer layer disposed between the cover and the clear coat layer, wherein the primer layer is formed by depositing a layer of a primer composition directly onto the outer surface of the cover.

17. The method of claim 16, wherein the primer composition comprises a water-based resin.

18. The method of claim 17, wherein the primer layer is deposited by means of dipping, spraying, spin, electrostatic or flow coating.

* * * * *